United States Patent [19]

David et al.

[11] 3,955,476

[45] May 11, 1976

[54] RADIAL PISTON-TYPE PUMP

[75] Inventors: Anton David, Gotzenhain; Peter Treusch, Mainz, both of Germany

[73] Assignee: ITT Industries, Inc., New York, N.Y.

[22] Filed: Aug. 1, 1974

[21] Appl. No.: 493,498

[30] Foreign Application Priority Data

Aug. 14, 1973 Germany ..... 2341013

[52] U.S. Cl. ..... 91/491

[51] Int. Cl.[2] ..... F01B 13/06

[58] Field of Search ..... 91/498, 491

[56] References Cited

UNITED STATES PATENTS

| | | | |
|---|---|---|---|
| 2,868,136 | 1/1959 | Bonadek | 91/498 |
| 3,433,124 | 3/1969 | Parrett | 91/501 |

FOREIGN PATENTS OR APPLICATIONS

| | | | |
|---|---|---|---|
| 105,638 | 4/1917 | United Kingdom | 91/491 |
| 583,396 | 12/1946 | United Kingdom | 91/491 |
| 995,651 | 6/1965 | United Kingdom | 91/498 |

*Primary Examiner*—William L. Freeh

*Attorney, Agent, or Firm*—J. B. Raden; D. P. Warner

[57] ABSTRACT

A radial piston-type pump is disclosed which includes a non-rotating control pin projecting into a cup-shaped housing. A pivoted cylinder block having radial holes is arranged on the pin. As the cylinder block rotates, the holes are alternately connected with a suction line and a pressure line. A connecting channel is provided which leads from the radial outer area of the inside chamber of the housing to the suction line of the pump.

5 Claims, 7 Drawing Figures

RADIAL PISTON-TYPE PUMP

BACKGROUND OF THE INVENTION

1. Field of the Invention

The invention relates to a radial piston-type pump which is provided with means to discharge oil which accumulates in the housing into the suction line of the pump.

This invention relates, in greater detail, to a radial piston-type pump with a non-rotating control pin projecting into a cup-shaped housing. A pivoted cylinder block is arranged on the control pin and is designed to include one or more radial cylinder holes which - when the cylinder block is rotating - are alternately connected with a suction line and a pressure line. Pistons are included which are guided so that their end surfaces, which project to the outside, rest against a stroke ring eccentrically arranged relative to the control pin.

2. Description of the Prior Art

From the Swiss patent CH-PS 377,035 a radial piston-type engine is known which is designed with a non-rotating control pin one end of which is staggered relative to the pump axis. A cylinder block is rotatably disposed on this end. This cylinder block is designed with cylinder holes which — when the cylinder block is rotating — are alternately connected via chambers with the suction line and the pressure line arranged in the control pin. The pistons guided in the cylinder holes are of concave design at their end surfaces projecting to the outside, and abut the cupshaped inner wall of the housing above roller bodies arranged in these concave groovings, which inner wall serves as a piston stroke curve at the same time. When the pump is in operation, the pump housing rotates, thus causing — via the roller bodies — the cylinder block to follow the rotational movement owing to the concave end surfaces of the pistons. In this process the eccentric arrangement of the cylinder block causes the stroke movement of the pistons at the cylinder holes.

In such pumps leakage losses occur at the place where the cylinder block is arranged on the control pin, and in the piston guides. The pressure medium, oozing out of the pump circulation system through the crevice between these members, accumulates in the housing, thus filling it. If this pressure medium is not discharged, as is done in the device according to the Swiss patent CH-PS 377,035, it will become the subject of turbulences due to the moving pump members when the pump is in operation. The turbulences, which are very strong on account of the heterogeneity of the movements of the single pump members, cause loud noises and cause the rotational movement of the rotary members to slow down, resulting in a lower delivery rate for the pump. In addition, these turbulences produce underpressure areas, causing cavitation which leads to noise development and damage to the members.

SUMMARY OF THE INVENTION

It is an object of this invention to provide a radial piston-type pump, wherein the pressure medium which due to leakage losses enters into the housing is directly discharged to the suction line of the pump.

According to this invention this object is achieved in that a connecting channel is lead from the radially outer area of the inside chamber of the housing to the suction line of the pump. When the pump is in operation, the waste oil is hurled against the cylindrical inside wall of the housing on account of the rotary pump members, and passes via the connecting channel directly to the suction line of the pump.

An advantageous embodiment of the invention is to design the connecting channel in a way that it ends at that place in the inside chamber of the housing, where there is least distance between the eccentrically disposed piston stroke ring and the cylindrical inner wall of the housing, as at this place the highest centrifugal and dynamic pressure of the pressure medium develops.

In an another inventive embodiment of the radial pistontype pump the connecting channel leads from an annular channel, which is designed at the radially outer area of the bottom of the housing, to the suction line of the pump.

The connecting channel can also be defined by an interspace between the bottom of the housing and a wall with a smaller diameter than the internal diameter of the housing, which wall is disposed a distance off the bottom of the housing. This wall can also be designed with the same diameter as the bottom of the housing, and with openings in its radially outer area. A specific embodiment of the wall is that it is designed as a disc arranged on the control pin.

It is advantageous to arrange the openings at that place of the wall where there is least distance between the eccentrically disposed piston stroke ring and the cylindrical inner wall of the housing, as at this place — as already mentioned — the highest centrifugal and dynamic pressure develops.

In order to take advantage — besides of this centrifugal and dynamic pressure — also of the flow of pressure medium caused by the rotational movement of the piston stroke ring, it is desirable to design vane-shaped deflectors at the rear edges of the openings, as seen in the direction of rotation of the rotor, which deflectors are inclined against the direction of rotation of the rotor. These vane-shaped deflectors can be favorably constructed by punching them out of the wall, and — during the punching process — by causing them to project out of the plane of the wall in a peripheral direction.

If in an inventive radial piston-type pump, the pressuremedium supply line is arranged in such a way that it ends in the inside chamber of the housing, the pressure medium, which is hurled against the inside wall of the housing on account of the inside members of the pump, is advantageously fed to the pump via the suction line under a prestress.

The advantages obtained with this invention are especially that a strong noise reduction is achieved resulting from the direct discharge of the waste oil out of the pump housing. The fact that in this method underpressure areas are not allowed to develop in the inside chamber of the pump as well, and thus cavitation is avoided, leads to the prevention of noise development, and moreover, of damage to the inside members of the pump.

In a pump wherein the pressure medium enters — via a direct connection from the pressure-medium reservoir — into the inside chamber of the housing, the rotary members of the pump hurl this pressure medium against the inside wall of the housing. Moreover, dynamic pressure develops at the place where there is least distance between the piston stroke ring and the inside wall of the housing. If the suction line of the pump ends in the inside chamber of the housing at this place, the pressure medium is advantageously fed to the pump under a certain prestress.

There is also the possibility to utilize this centrifugal and dynamic pressure for a second pressure-medium circulation system.

It is a favorable embodiment of the pump housing to manufacture this member of a casting and to integrally cast the single pressure-medium channels.

BRIEF DESCRIPTION OF THE DRAWINGS

An embodiment of the invention is illustrated in the drawings, in which.

DESCRIPTION OF PREFERRED EMBODIMENTS

Figure 1:
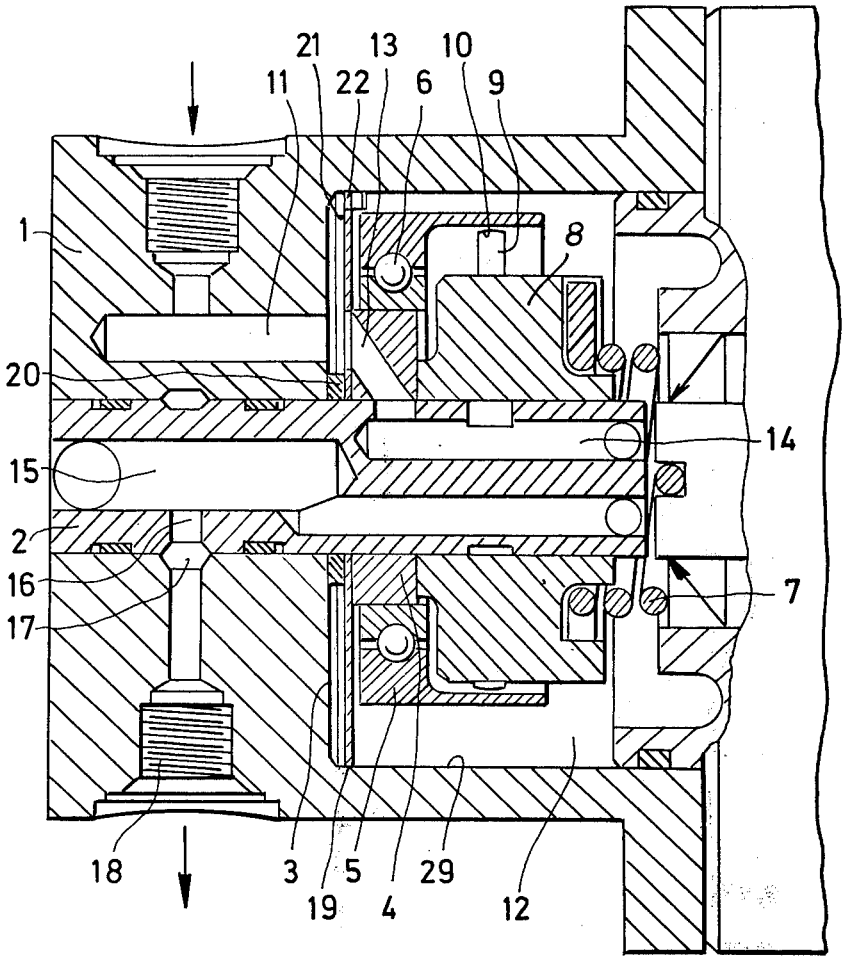
FIG. 1 shows an embodiment of an inventive radial pistontype pump in cross-section.

A control pin 2 is arranged in a non-rotating manner in a cup-shaped housing 1 of a radial piston-type pump. On the part of the control pin 2 freely projecting out of the bottom 3 of the housing 1, the eccentric piston stroke ring 4 is arranged, the cup-shaped outer part 5 of which is rotatably arranged via roller bearings 6. A cylinder block 8 which is operable via a clutch spring 7 is rotatably disposed on the control pin 2. This cylinder block 8 is designed with cylinders, in which pistons 9 are arranged, resting against the rotatable part of the piston stroke ring 5 with their end surfaces 10 projecting to the outside.

At the bottom 3 of the housing 1, a suction channel 11 ends in the inside chamber 12 of the housing 1, and is continued in the form of a hole 13 in the stationary part of the piston stroke ring 4, and of a hole 14 in the control pin 2, where it overlaps the working cylinders when the cylinder block 8 is rotating. The pressure line as well is defined by an axial hole 15 in the control pin 2, and is guided via a connecting hole 16 to an annular channel 17 connected with a pressure connector 18. In FIG. 1, a connecting channel 21 is defined by a disc 19, which is - owing to a spacer piece 20 - arranged at a distance from the bottom 3 of the housing 1, by means of which connecting channel 21 the inside chamber 12 of the housing 1 is connected with the suction channel 11 via openings 22.

Figure 3:
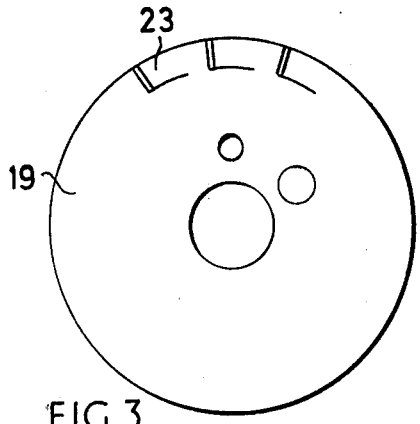
FIG. 3 shows a disc, such as is mounted in the subject-matter of FIG. 1.
Figure 4:
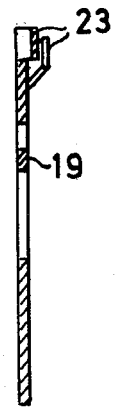
FIG. 4 shows a side view of the subject-matter of FIG. 3, in section.
Figure 5:
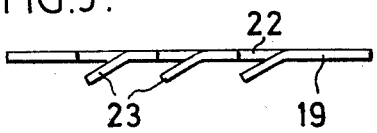
FIG. 5 shows the subject-matter according to FIG. 3, in topview.

FIGS. 3, 4 and 5 show such a disc 19, wherein the openings 22 are punched out, and wherein — during the punching process — the punched-out lugs 23 project slantingly out of the plane of the disc and are deflected. In this manner, these lugs 23 serve the purpose of vane-shaped deflectors at the same time.

Figure 2:
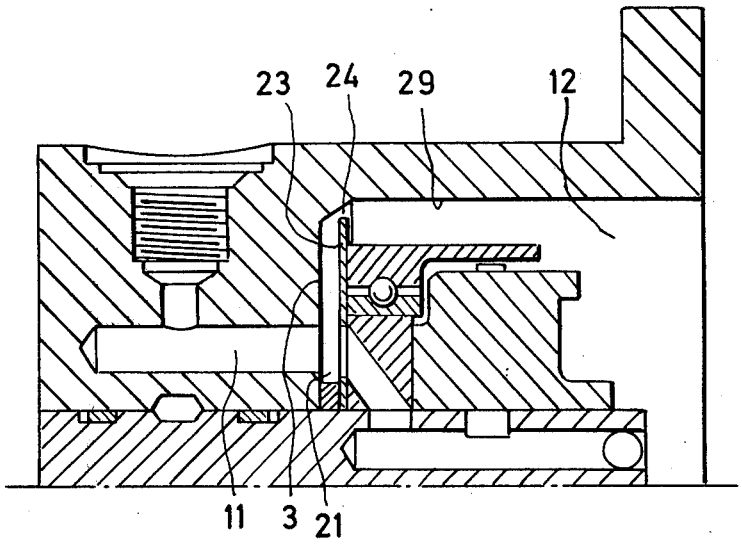
FIG. 2 shows a portion of a second embodiment of an inventive radial piston-type pump in cross-section.
Figure 6:
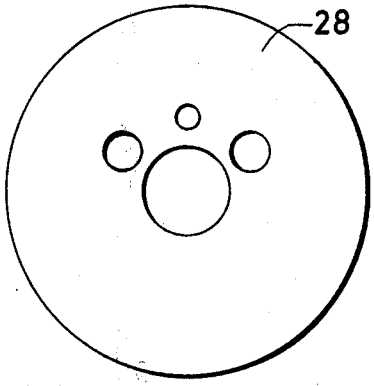
FIG. 6 shows a disc, such as is mounted in the subject-matter of FIG. 2.

By incorporating a disc 28 in the inventive radial piston-type pump, shown in FIG. 2, the connecting channel 21 is established between the bottom of the housing 3 and this disc 28. As the diameter of the disc 28 is smaller than the internal diameter of the housing 1, an annular channel 24 is established between the inside wall 29 of the housing 1 and the disc 28, which channel 24 connects the inside chamber 12 of the housing 1 with the connecting channel 21, and thereby with the suction connector 11. The disc 28 is illustrated in FIG. 6.

Figure 7:
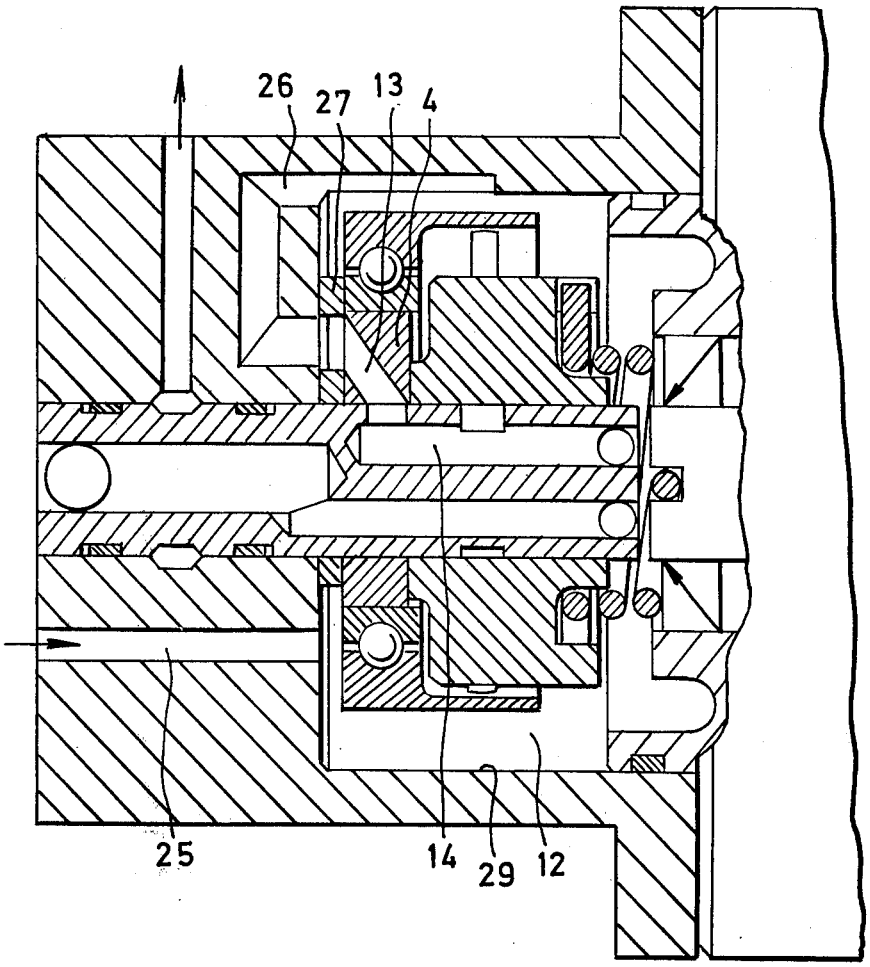
FIG. 7 shows a third embodiment of an inventive radial piston-type pump.

In the radial piston-type pump, illustrated in FIG. 7, the pressure-medium supply line 25 ends in the inside chamber 12 of the housing 1. At that place, where there is least distance between the piston stroke ring 5 and the inside wall of the housing 1, a channel 26 ends in the inside chamber 12 of the housing 1, which leads through the housing 1 to the hole 14 via hole 13 in the stationary part 4 of the piston stroke ring. The channels 26 and 13 are packed relative to the inside chamber 12 of the housing 1 by a seal 27.

While the principles of the invention have been described above in connection with specific apparatus and applications, it is to be understood that this description is made only by way of example and not as a limitation of the scope of the invention.

We claim:

1. A radial piston-type pump with a non-rotating control pin projecting into a cup-shaped housing, the control pin supporting a pivoted cylinder block including one or more radial cylinder holes which - when the cylinder block is rotating - are alternately connected with a suction line and a pressure line, means guiding pistons having end surfaces which project to the outside to rest against a stroke ring eccentrically arranged relative to the control pin, a connecting channel leading from the radial outer area of the inside chamber of the housing to the suction line of the pump, said connecting channel being defined by the interspace between the bottom of the housing and a wall disposed a distance off the bottom of the housing, the wall including openings in a radially directed outer area, and the wall being designed as a disc arranged on the control pin.

2. A radial-piston type pump, as claimed in claim 1, in which a pressure-medium supply line ends in the inside chamber of the housing.

3. A radial piston-type pump, as claimed in claim 1, in which the openings are arranged only at that place of the wall where there is least distance between the eccentrically disposed piston stroke ring and the cylindrical inner wall of the housing.

4. A radial piston-type pump, as claimed in claim 1, in which vane-shaped deflectors are designed at the rear edges of the openings, as seen in the direction of rotation of the rotor, which deflectors are inclined against the direction of rotation of the rotor.

5. A radial piston-type pump, as claimed in claim 4, in which the vane-shaped deflectors are punched out of the wall, and — during the punching process — are caused to project out of the plane of the wall in a peripheral direction.

* * * * *